US007523834B2

(12) United States Patent
Leinonen

(10) Patent No.: US 7,523,834 B2
(45) Date of Patent: Apr. 28, 2009

(54) HARVESTER CRANE

(75) Inventor: Yrjö Leinonen, Koljonvirta (FI)

(73) Assignee: Ponsse Oyj, Vierema (FI)

( * ) Notice: Subject to any disclaimer, the term of this patent is extended or adjusted under 35 U.S.C. 154(b) by 0 days.

(21) Appl. No.: 11/795,698

(22) PCT Filed: Feb. 23, 2006

(86) PCT No.: PCT/FI2006/050077

§ 371 (c)(1),
(2), (4) Date: Jul. 19, 2007

(87) PCT Pub. No.: WO2006/090015

PCT Pub. Date: Aug. 31, 2006

(65) Prior Publication Data

US 2008/0121603 A1 May 29, 2008

(30) Foreign Application Priority Data

Feb. 23, 2005 (FI) ..... 20055089

(51) Int. Cl.
*B66C 23/42* (2006.01)

(52) U.S. Cl. ..... 212/238; 212/261; 212/300

(58) Field of Classification Search ..... 212/300, 212/238, 261; 414/917
See application file for complete search history.

(56) References Cited

U.S. PATENT DOCUMENTS 3,995,756 A * 12/1976 Hjelm ..... 414/728
4,496,279 A * 1/1985 Langer ..... 414/735
4,583,907 A 4/1986 Wimberley
4,659,278 A * 4/1987 Doege et al. ..... 414/680
5,197,615 A 3/1993 Gunnarson
5,507,107 A * 4/1996 Pinomaki ..... 37/403
6,079,577 A 6/2000 Heikkila
6,193,087 B1 * 2/2001 Gunnarsson et al. ..... 212/300
6,550,625 B2 * 4/2003 Sundberg et al. ..... 212/300
6,860,396 B2 * 3/2005 Seppala ..... 212/300
2002/0060199 A1 5/2002 Sundberg et al.

FOREIGN PATENT DOCUMENTS

SE 383991 4/1976
WO 01/56915 8/2001

* cited by examiner

*Primary Examiner*—Thomas J. Brahan
(74) *Attorney, Agent, or Firm*—Fildes & Outland, P.C.

(57) ABSTRACT

The invention relates to a harvester crane, which includes a set of booms, which are attached by means of a pedestal and rotating device to a chassis machine, in which the set of booms includes a main boom, which is pivoted at its lower end by a lower pivot to the pedestal; and an articulated boom, which is pivoted by an upper pivot to the opposite end of the main boom and which extends its path mainly forward from the main boom; operating devices, i.e. a lift device and a transfer device, operating the booms. The lower pivot of the main boom is located low down near to the rotating device and the pedestal is fork-shaped, the lower arm and the lift cylinder being located at least partly inside it.

9 Claims, 5 Drawing Sheets

HARVESTER CRANE

SCOPE OF THE INVENTION

The present invention relates to a harvester crane according to the preamble to Claim 1.

As is known, cranes of this kind are used, for example, in forestry machines for moving and processing pieces of timber, or entire trees. In particular, single-grip harvesters use so-called harvester cranes, which can be envisaged as being referred to in the solution according to the invention. The term harvester crane is used generally for at least timber cranes and loaders, the outer point of the set of booms of which, thanks to its pivot geometry, implements some sort of more or less straight movement, preferably essentially horizontally in the area of the reach of the crane, when only one operating device (typically a so-called transfer cylinder) operates.

The loader manufactured by the Swedish company Mowi system AB is very close to the type according to the preamble. In it, the lower arm is situated at the end of a high pedestal column, so that the lift cylinder operates in a nearly vertical position.

Usually, various kinds of work devices, such as felling heads, or loading grabs and buckets, are used in connection with a loader or crane. Such devices are typically attached to the outer end of the sets of booms. In addition, the set of booms of the crane are attached to a chassis machine, such as a forestry machine, with the aid of some kind of rotating device. It is also possible that there is also some kind of pedestal, to which the set of booms is attached, between the rotating device and the set of booms. Solutions are also known, in which the position of the rotating device relative to the chassis machine can be altered and tilted, for example, to facilitate working on slopes. Tilting arrangements of this kind can be used, for example, to seek to turn the axis of rotation of the rotating device to an essentially vertical position, independently of the form of the ground. Two main types of rotating device are known. In a cylinder rotating device, one or more hydraulic cylinder turns, for example, a rack on the base component and by means of toothing attached to the set of booms while in the toothed ring type a hydraulic motor drives, though a small pinion, a ring equipped with internal and external toothing. The diameter of the toothed ring has been typically 8-10% of the length of the main boom.

In addition, it is known that an extension or continuation can be fitted, in a manner that is as such known, to the outer end of the set of booms, with the aid of which the reach of the booms can be increased. Typically, an extension of this kind is implemented as a combination of a telescopic construction that slides into itself and a pressure-medium operated operating device driving the extension.

BACKGROUND TO THE INVENTION

Numerous different kinds of loader are known, in which the set of booms is arranged to be controlled, for example, using pressure-medium operated operating devices, such as hydraulic cylinders. Particularly harvester cranes can be stated to usually comprise a single lift cylinder and a single transfer cylinder. In accordance with its name, the movement of the lift cylinder essentially determines the height position of the outer end of the set of booms while correspondingly the transfer cylinder determines essentially the horizontal position of the outer end of the set of booms. Various harvester-crane implementations, particularly relating to forestry-machine applications, are disclosed in, for example, the following utility-model and patent publications: WO0156915, U20000471, FI961846, U.S. Pat. No. 5,197,615, FI20000978.

The aforementioned Mowi Ab loader (disclosed in Swedish patent publication SE7411568-4) has an advantageous path. If the path of the end of the articulated boom is thought of as being in front of the main boom, there is then a trapezium mechanism behind the main boom, which operates the articulated boom. The components of this mechanism are, in addition to the actual main boom, a lower arm pivoted at the same lower pivot as the main boom, a drag link parallel to the main boom, and arm means in the upper part of the main boom. In this case, the upper end of the drag link connected directly to the extension of the articulated boom. In more up-to-date loaders, a wide-angle joint is used, by means of which the relative rotation of the articulated boom can be increased. When the set of booms is being raised, the lift cylinder operates in compression, but is in danger of being hit by the load. In addition, the centre of gravity of the loader located disadvantageously high.

In one commercial harvester loader (Kesla Oyj, Forester H570), a rotating base in set on top of the pedestal, in which base there is a snout that carries the lower pivot and extends considerably, by means of which the reach is increased. The lift cylinder retracts inside a fork-shaped pedestal.

It is known that the operating device creating the lifting movement, the lift cylinder, can be arranged to the set of booms of the harvester crane to use either a pulling or pushing movement to lift the outer end of the set of booms. In the case of a pulling cylinder, the problem arises of the dimensions of the cylinder becoming unreasonably large in order to create a sufficient lifting force. In addition, the lift cylinder and the structures connected to it that come under a large tensile strain, particularly the structures made by casting, have proven to be unreliable in practice. On the other hand, in the case of a lift cylinder lifting with a pushing movement, the construction of the crane can become more complicated or heavier, while the cylinder is liable to receive a bucking load. In addition, in this case, the centre of gravity of the crane may become disadvantageously high (as in the Mowi). If the lift cylinder is located below the main boom, i.e. on the same side as that on which timber processing operations are carried out in timber harvesting, there is the danger that the lift cylinder will be damaged, for example, by being hit by a piece of timber or even by the felling head.

In forestry applications, cranes of this kind have been preferably hydraulically operated, so that the operating devices are mainly hydraulic cylinders. On the other hand, some solutions relating to this field of technology are known, in which the power transmission has been implemented in some other way, for instance with the aid of cables, or, for example, of electrical power.

BRIEF DESCRIPTION OF THE INVENTION

The present invention is intended to disclose new solutions to eliminate the defects of the prior art described above and for thus create a new, simpler, and surprising construction solution, the characteristic features of which are particularly the low centre of gravity of the crane and the overall solution, a great lifting power, and a naturally good protection of the lift cylinder.

This purpose is achieved in the manner defined by the characteristic features in the Claims. More specifically, the present invention is characterized by what is stated in the characterizing portion of Claim 1.

First of all, the invention is based on the idea that the lifting operation is implemented by a pushing work movement, with the aid of a lift operating device arranged to rise, so that the dimensions and weight of the operating device will remain reasonable while implementing a lifting force. In order to make the centre of gravity of the crane as low as possible, the lift cylinder is located inside the pedestal of the crane, in such a way that the lifting effect of the lift cylinder is transmitted to the drag link through an ancillary arm pivoted to the lower pin of the main boom. At the same time, the lift cylinder, and particularly its easily damaged piston rod, are advantageously protected by the pedestal. Generally, the lower pivot of the main boom is lower than the dimension from the pedestal of the distance between centres of the telescopic lifting operating device.

According to one preferred embodiment, the rotating device is of a type with a toothed ring. The diameter of the bearing ring is preferably 13-25% of the pivot length (=distance between the pivot centres) of the main boom. The pedestal then naturally extends quite far forward and protects the lift cylinder and its front pivot in the ancillary arm. The total structure is low. The path of the front pivot preferably runs entirely on top of the structures (at the position of the ring opening, even below the pedestal level).

According to a second embodiment, the said lower pivot is located substantially closer to the axis of rotation of the rotating device than the pivot of the lifting device in the pedestal. The low and protected construction also has the effect of locating the lug in the pedestal for the lifting device advantageously at the same height as, or higher than the lowest point of the path of the pivot at the opposite end of the lifting device.

The operating devices operating the set of booms are preferably pressure-medium-operated operating devices, preferably hydraulic cylinders.

Other advantages and embodiments of the invention are presented hereinafter.

BRIEF DESCRIPTION OF THE FIGURES

In the following, one preferred embodiment of the invention is examined with reference to the accompanying drawings, in which.

DETAILED DESCRIPTION OF SOME EMBODIMENTS

Figure 1:
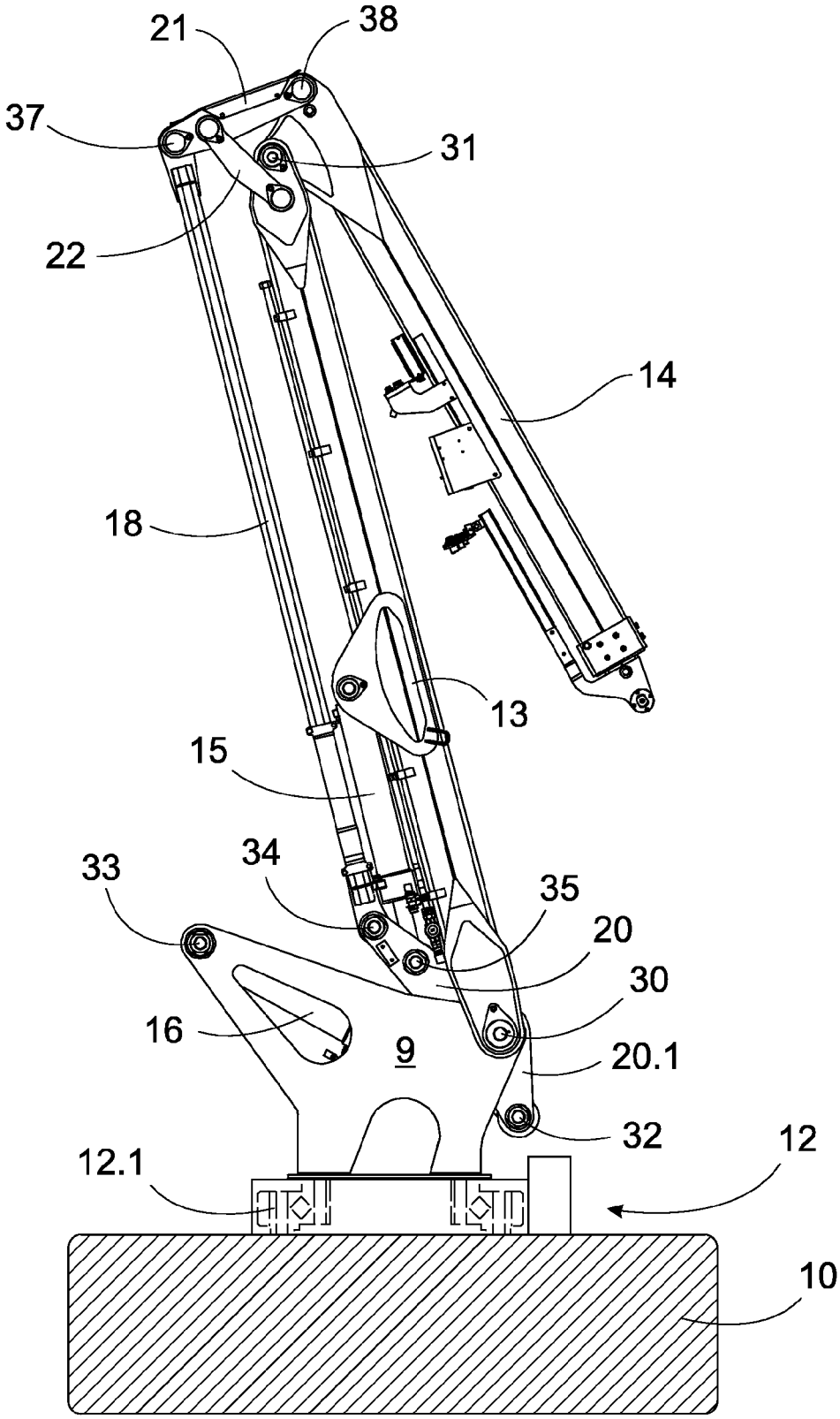
FIG. 1 shows the crane in the vertical position and retracted.

The crane of FIGS. 1-4 is intended to be installed on the frame of a forestry machine, i.e. generally on a chassis machine, which is marked schematically with the reference number 10 in FIG. 1. The pedestal 9 of the crane is secured through the rotating device 12 to the chassis machine 10. In the rotating device, there is preferably a toothed ring driven by a pinion, and which is on the outer or inner circumference of the ring bearing. One such ring bearing 12.1 is drawn in FIG. 1 by broken lines inside the rotating device 12.

In one model, the ring bearing used is a stewing ring of the ROLLIX® type. The bearing diameter is 823 mm and the diameter of the outer toothed ring is 962 mm. As the pivot length of the main boom is 4720 mm, the bearing diameter is 17% of this. Generally, the range is 13-25%, preferably 15-20%. For its part, a rotating device with a considerably large diameter and a pinion drive permits a low pedestal structure with a pushing lift cylinder.

The said tilting device can be between the rotating device and the chassis machine.

The main boom 13 is supported from the pedestal 9 through the lower pivot 30 while the articulated boom 14 is, in turn, attached to the main boom 13 through the upper pivot 30. The articulated boom 14 preferably includes telescopic means in a known manner while the path of the end is located in front of the main boom 13. Fitted to the lower pivot 30 supported by the pedestal 9 is the lower arm 20 of the trapezium mechanism, to the rear end of which the drag link 18 of the mechanism is attached through pivot 34, and which in turn operates the articulated boom 14 through a wide-angle pivot. The wide-angle pivot is of a known type, comprising an arm 21 between the pivot 37 at the upper end of the drag link 18 and the pivot 38 of the articulated boom 14, as well as a synchronizing arm 22 attached by pivots to the main boom.

The transfer cylinder 15 is connected to the centre pivot 35 of the fork-shaped lower arm 20, while its opposite end is connected to the main boom 13, the lift cylinder 16 being supported by a pivot 33 from the lug of the pedestal 9 and is connected through a pivot 32 to the extension 20.1 of the lower arm 20.

The pedestal construction differs substantially from the previously known construction. The pedestal 9 has a fork shape, so that both the lower arm 20 and the lift cylinder 16 can fit inside it and be able to move. The lift cylinder 16 could be in a horizontal position very close to the pedestal, but the application according to FIGS. 1-4 is intended for a forestry machine, in which there are structures close to the ring bearing. The pivot 33 of the lift cylinder 16 is substantially farther than the lower pivot 30 from the axis of rotation. In that case, the pivot 32 of the extension 20.1 of the lower arm 20 to the lift cylinder 16 and the piston rod of the lift cylinder 16 practically do not protrude into the area of the ring bearing. The cylinder can also be installed the other way round, in which case it will be even more protected. The path of this pivot 32 is dimensioned to be as far down as possible—in practice the smallest distance of the path form the structures of the rotating device is less than 35 cm and runs entirely on top of the structures. To a great extent, this determines the height position of the lower pivot 30, which always remains, however, the dimension of the retracted lift cylinder, measured from the lowest base of the pedestal.

Figure 2:
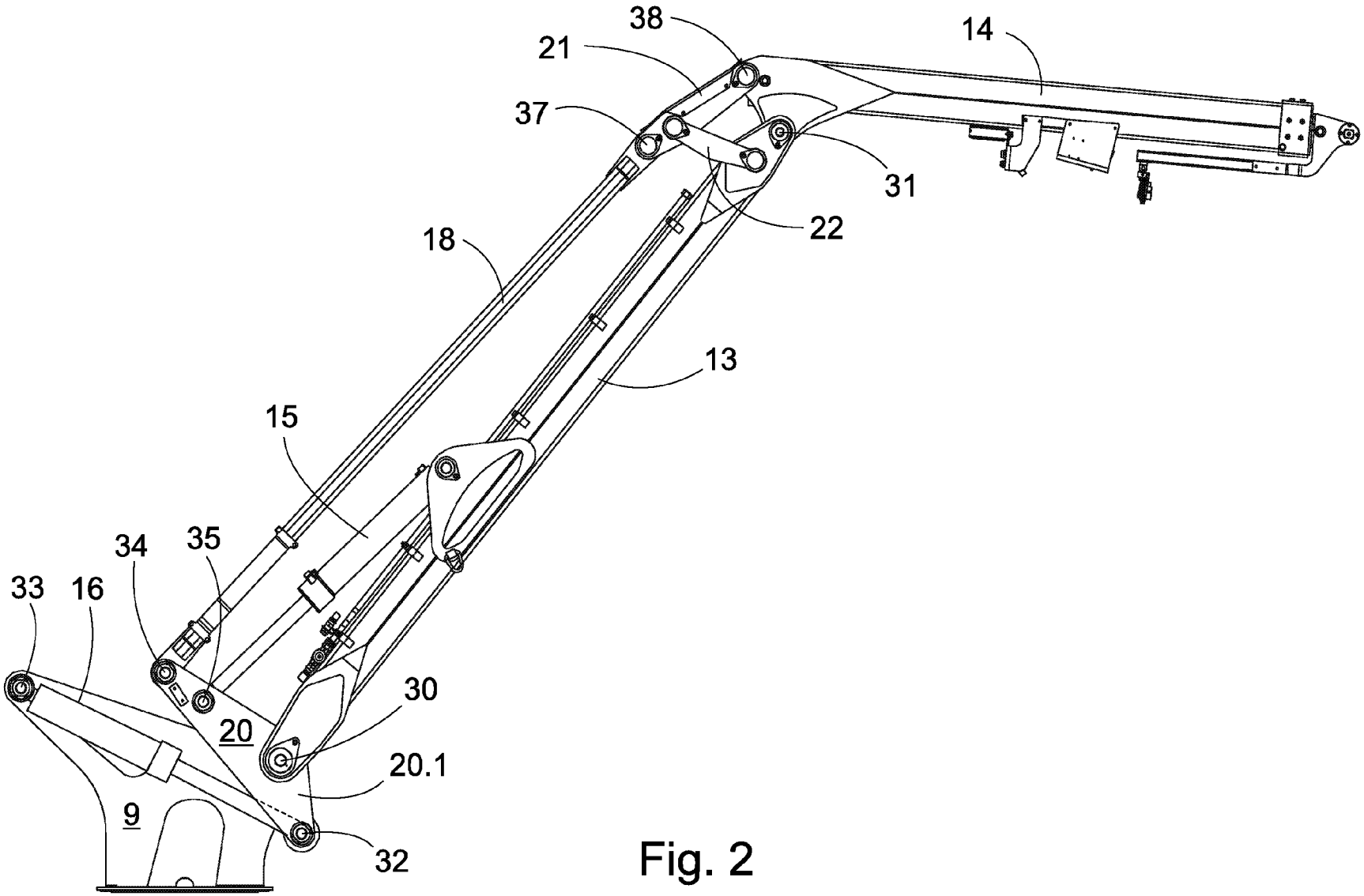
FIG. 2 shows the articulated boom of the crane rotated open and with the side of the pedestal removed.
Figure 3:
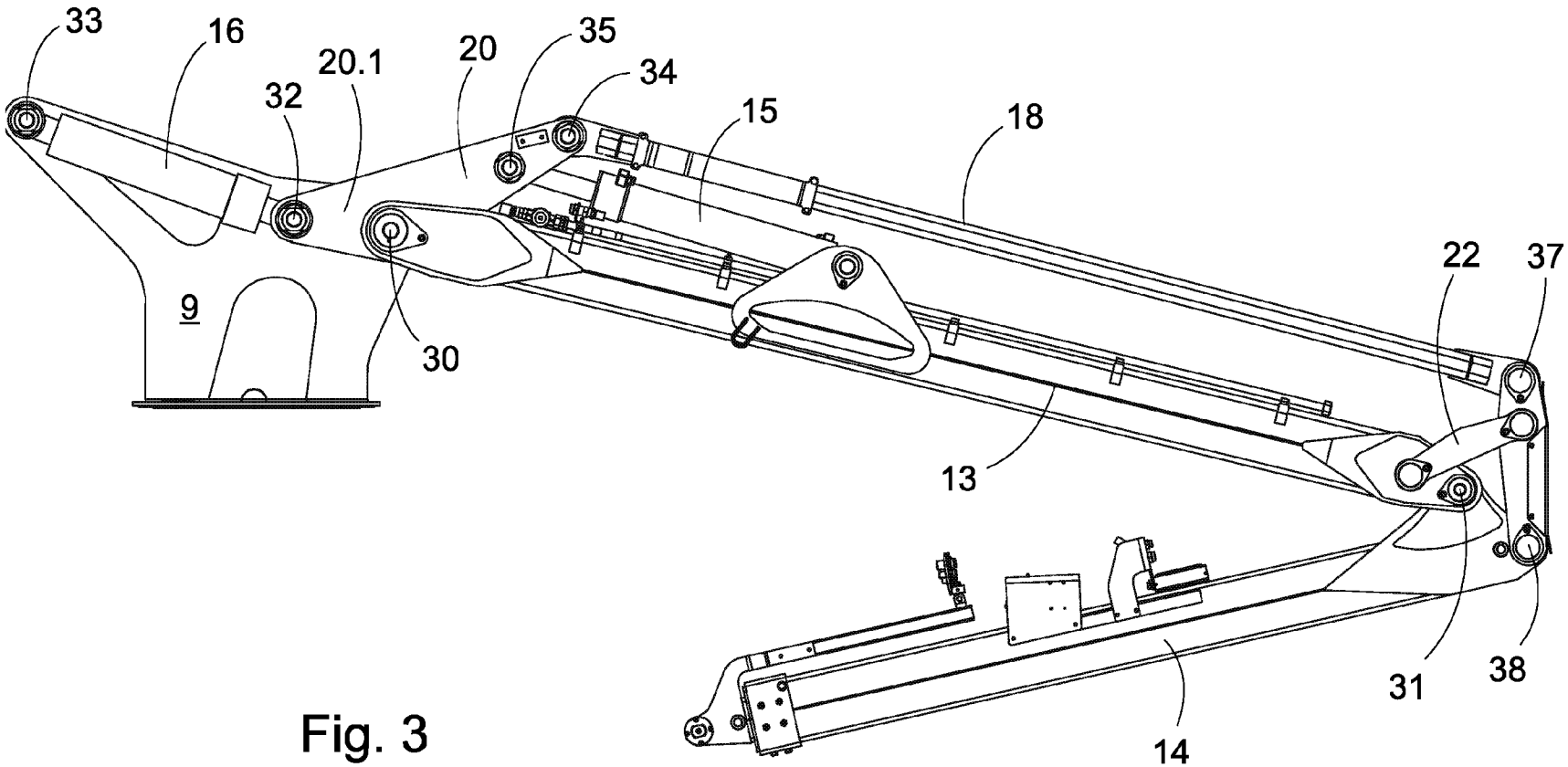
FIG. 3 shows the crane lowered, retracted, and with the side of the pedestal removed.

In FIG. 2, the position of the lift cylinder 16 is essentially the same as in FIG. 1, but the articulated boom 14 has been straightened using the transfer cylinder 15. In FIGS. 2 and 3, the side plate has been removed, so that the position and operation of the lift cylinder 16 can be seen clearly.

Figure 4:
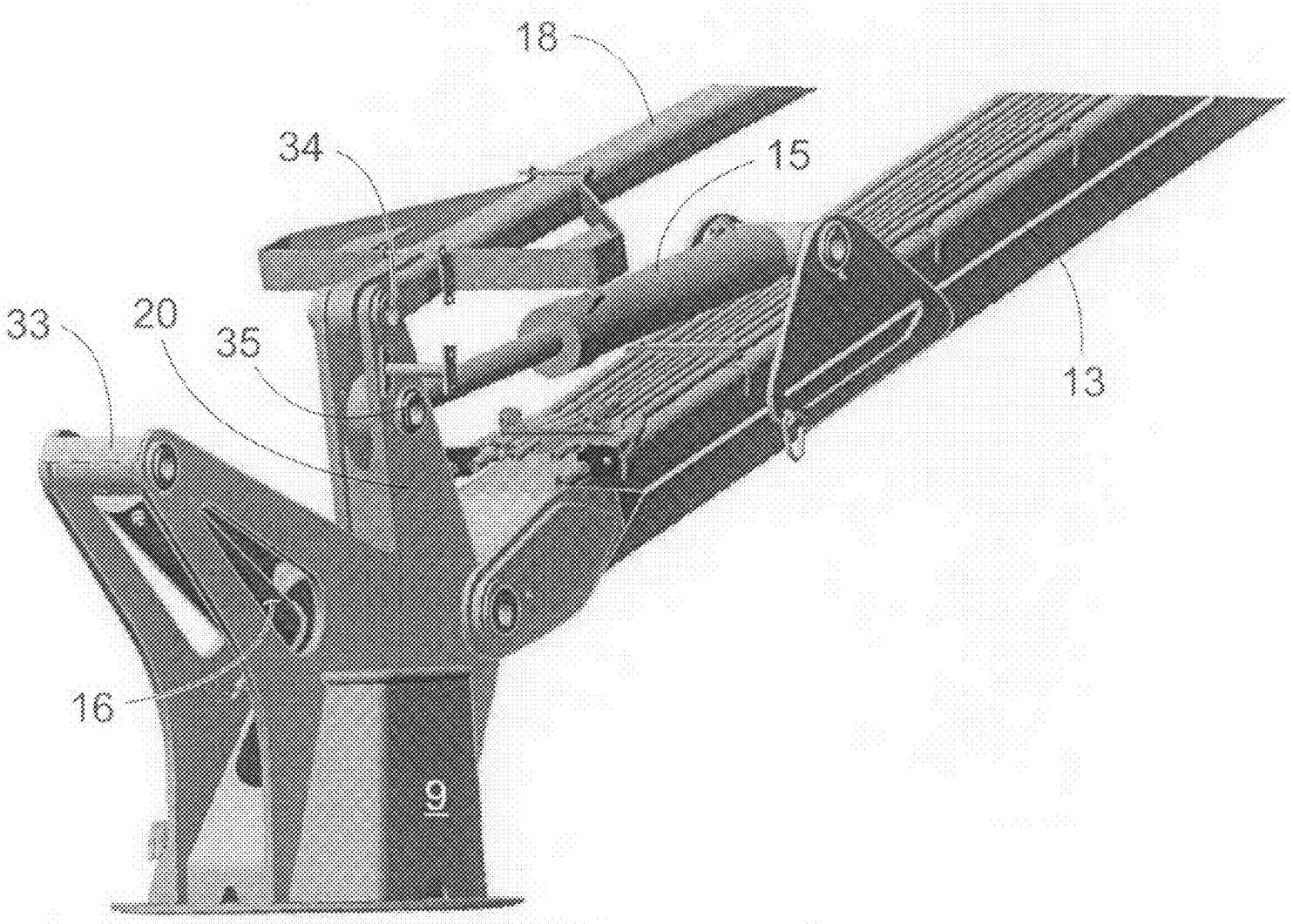
FIG. 4 shows an isometric view of the lower part of the crane, seen at an angle from the rear.

The isometric view in FIG. 4 includes the hydraulic pipe runs and other equipment relating to the crane.

Figure 5:
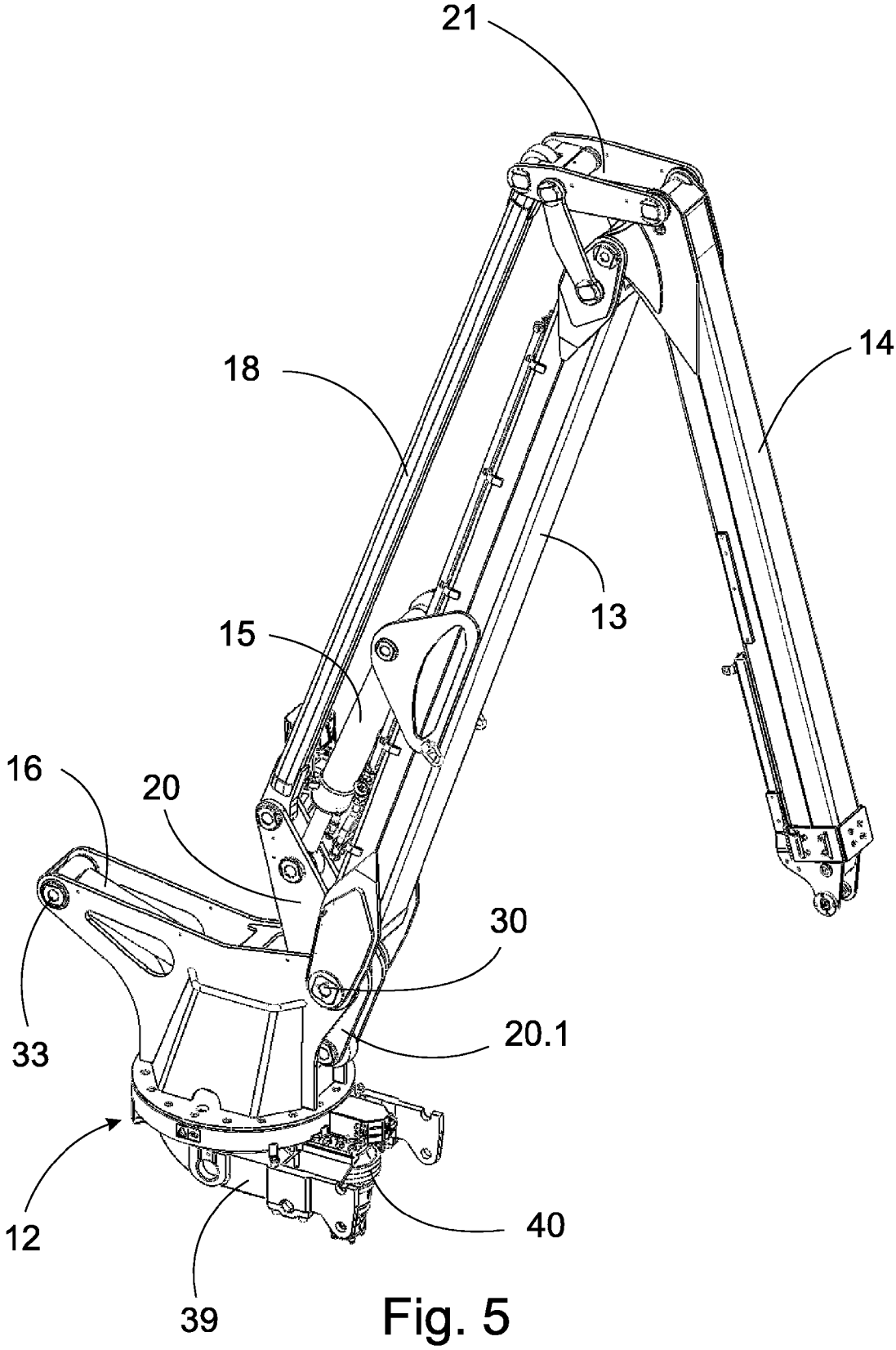
FIG. 5 shows an axonometric view of a second crane.

In the embodiment according to FIG. 5, the same reference numbers as above are used for operationally similar components. The construction of the actual set of booms is the same, i.e. the main boom 13, articulated boom 14, drag link 18, lower arm 20 with an extension 20.1, wide-angle pivot, lift cylinder 16, and transfer cylinder 15 have the same construction as above. Also the fork-shaped pedestal 9 has almost the same construction as above. In this version there is also, however, a tilt device 39, which is shown without hydraulic cylinders. In this model, the rotating device 40, which comprises a toothed ring rotated by a hydraulic motor, is mainly below the ring bearing. However, it is essential that the support structures extend so far in front that the path of the front pivot 32 of the lift cylinder 16 in the extension 20.1 always runs above the structures and, in addition, mainly inside the fork-shaped pedestal. In this case, the 'structures' can also be structures of the chassis machine, which prevent the load or machine from striking the front pivot 32, or particularly the piston rod of the lift cylinder 16.

The ring bearing permits practical hose runs, because all the hydraulic hoses (more generally the energy and data-transfer lines) can be led well protected through the ring bearing and out of the line of vision of the driver. It is also possible to use as such known feed-through components that permit rotation, for several of the hydraulic hose runs.

The embodiments described above are the most preferable embodiments of the invention. The invention is not, however, restricted to only these, but instead can be varied in many different ways within the scope of the inventive idea and the Claims.

The invention claimed is:

1. Harvester crane comprising a set of booms attached to a chassis by means of a fork-shaped pedestal and rotating device, the fork-shaped pedestal having two opposite sides, the set of booms including a main boom, pivotably connected to the pedestal at its lower end between said two opposite sides by a lower pivot, the lower pivot of the main boom being located adjacent the rotating device; and an articulated boom, which is pivoted by an upper pivot at the opposite end of the main boom and which extends forward from the main boom;

operating devices comprising a lift cylinder and a transfer cylinder that operate the booms; and a trapezium mechanism, synchronizing the set of booms, which further includes a drag link disposed parallel to and behind the main boom and having lower and upper ends, a lower arm pivotably connected to the lower pivot of said main boom and the lower end of the drag link, connecting the lower end of the drag link to the lower pivot of the main boom, and the lower arm having an extension on the opposite side of the lower pivot relative to the drag link, and an arm assembly at the upper end of the drag link, connecting the upper end of the drag link operationally to both the main boom and the articulated boom; wherein the lift cylinder being pivotable at one end to the pedestal and at an opposite end to the extension of the lower arm relative to said lower pivot, in which case the lifting of the set of booms takes place by operation of the pushing of the lift cylinder by an expanding work movement, and the lower arm and the lift cylinder are located at least partly between the opposite sides of the pedestal, and the transfer cylinder pivots one end of the lower arm and an opposite end to the main boom, said transfer cylinder being located between the drag link and the main boom.

2. Harvester crane according to claim 1, wherein the rotating device comprises a ring bearing equipped with circumferential toothing, and a rotating device driving this circumferential toothing.

3. Harvester crane according to claim 2, wherein the bearing diameter of the ring bearing is 13-25% of the length of the main boom.

4. Harvester crane according to claim 2, wherein the ring bearing provides a passageway.

5. Harvester crane according to claim 1, wherein the said lower pivot is located closer to the axis of rotation of the rotating device than the lift cylinder's pivot in the pedestal.

6. Harvester crane according to claim 1, wherein the lift cylinder's pivot in the pedestal is located at the same height as or higher than a lowest point of a path of the pivot of the opposite end of the lift cylinder.

7. Harvester crane according to claim 1, wherein a path of the pivot connecting the lift cylinder to the lower arm is arranged to run above the pedestal, rotating device, and other structures.

8. Harvester crane according to claim 1, wherein the said operating cylinders are hydraulic cylinders.

9. Harvester crane according to claim 1, wherein the arm assembly of the trapezium mechanism comprises a wide-angle pivot.

* * * * *